US008950088B2

(12) United States Patent
Aveni et al.

(10) Patent No.: US 8,950,088 B2
(45) **Date of Patent: *Feb. 10, 2015**

(54) ARTICLE OF FOOTWEAR WITH TONGUE HAVING HOLES

(71) Applicant: NIKE Inc., Beaverton, OR (US)

(72) Inventors: Michael A. Aveni, Lake Oswego, OR (US); Martine I. V. Mientjes, Beaverton, OR (US); Kelly McKean, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/164,669

(22) Filed: Jan. 27, 2014

(65) Prior Publication Data

US 2014/0202043 A1 Jul. 24, 2014

Related U.S. Application Data

(63) Continuation of application No. 12/949,100, filed on Nov. 18, 2010, now Pat. No. 8,661,712.

(51) Int. Cl.
*A43B 23/26* (2006.01)
*A43B 23/02* (2006.01)

(52) U.S. Cl.
CPC ..... *A43B 23/26* (2013.01); *A43B 23/0215* (2013.01); *A43B 23/023* (2013.01); *A43B 23/0235* (2013.01); *A43B 23/028* (2013.01)
USPC ..... 36/54

(58) Field of Classification Search
CPC ..... A43B 23/26; A43B 1/009; A43B 3/0036; A43B 7/085; A43B 23/0265; A43B 23/027; A43B 23/0275; A43B 23/028
USPC ..... 36/54, 133, 45
See application file for complete search history.

(56) References Cited

U.S. PATENT DOCUMENTS

| | | | |
|---|---|---|---|
| 1,753,415 | A | 4/1930 | Hepburn |
| D97,810 | S | 10/1935 | Gleason |
| D102,736 | S | 1/1937 | Andrews |
| 3,076,274 | A | 2/1963 | Schlecht |
| 3,284,931 | A | 11/1966 | Dassler |
| 3,413,736 | A | 12/1968 | Spiteri |
| 4,053,995 | A | 10/1977 | Shein |
| 4,458,429 | A | 7/1984 | Schmid |
| 4,509,276 | A | 4/1985 | Bourque |
| 4,559,723 | A | 12/1985 | Hamy et al. |
| 4,835,885 | A | 6/1989 | Hoshizaki et al. |
| 4,920,666 | A | 5/1990 | Marega |
| D317,824 | S | 7/1991 | Hatfield |
| 5,050,319 | A | 9/1991 | Perotto et al. |
| 5,158,767 | A | 10/1992 | Cohen et al. |

(Continued)

FOREIGN PATENT DOCUMENTS

| | | |
|---|---|---|
| FR | 2783678 | 3/2000 |

*Primary Examiner* — Ted Kavanaugh
(74) *Attorney, Agent, or Firm* — Plumsea Law Group, LLC

(57) ABSTRACT

An article of footwear includes a tongue. The tongue includes a medial portion, a lateral portion, a central portion, a top portion and an upper perimeter portion. The lateral portion, the central portion and the upper perimeter portion include holes. The top portion and medial portion are substantially solid portions without holes. Each portion of the tongue corresponds to a different pressure zone along a foot in order to provide differential cushioning and support against pressure applied by a fastening system.

20 Claims, 9 Drawing Sheets

(56) References Cited

U.S. PATENT DOCUMENTS

| | | | | |
|---|---|---|---|---|
| 5,265,353 | A | 11/1993 | Marega et al. | |
| 5,276,983 | A | 1/1994 | Hatfield | |
| 5,511,323 | A | 4/1996 | Dahlgren | |
| 5,575,090 | A * | 11/1996 | Condini | 36/54 |
| 5,955,159 | A | 9/1999 | Allen et al. | |
| 6,094,841 | A | 8/2000 | Adams | |
| 6,128,837 | A | 10/2000 | Huang | |
| 6,234,988 | B1 | 5/2001 | Brother et al. | |
| 6,237,253 | B1 | 5/2001 | Feuerecker | |
| 6,360,454 | B1 | 3/2002 | Dachgruber et al. | |
| 6,401,364 | B1 | 6/2002 | Burt | |
| 6,460,197 | B2 | 10/2002 | Huang | |
| 6,993,860 | B2 | 2/2006 | Bettiol | |
| 7,140,128 | B2 * | 11/2006 | Huckle | 36/54 |
| D550,948 | S | 9/2007 | Pelsue | |
| 7,325,813 | B2 | 2/2008 | Bock | |
| 7,562,470 | B2 | 7/2009 | Keen | |
| 7,941,943 | B2 | 5/2011 | Baker et al. | |
| 8,661,712 | B2 * | 3/2014 | Aveni et al. | 36/54 |
| 8,677,654 | B2 | 3/2014 | Aveni et al. | |
| 2002/0144434 | A1 | 10/2002 | Farys et al. | |
| 2009/0071041 | A1 | 3/2009 | Hooper | |
| 2009/0158504 | A1 | 6/2009 | Sparrow et al. | |

* cited by examiner

ARTICLE OF FOOTWEAR WITH TONGUE HAVING HOLES

CROSS-REFERENCE TO RELATED APPLICATION

This application is a continuation of application Ser. No. 12/949,100 filed Nov. 18, 2010, corresponding to U.S. Patent Application Publication No. 2012/0124863, published on May 5, 2012, the disclosure of each of which is hereby incorporated by reference in its entirety.

BACKGROUND

The current embodiments relate generally to footwear, and in particular a tongue for an article of footwear.

Articles of footwear can include fastening systems such as laces, straps and zippers. Laces are generally attached to the top of an upper, and help to tighten an opening around a foot. Typically, a tongue is provided along the upper, which rests between a foot and the laces. The tongue can help in adjusting the lacing system. The tongue can act to cover the top of the foot in the region of the opening.

SUMMARY

In one embodiment, an article of footwear includes an upper, the upper including an opening and a fastening region associated with the opening. The article of footwear also includes a tongue, the tongue including a first portion and a second portion, where the first portion includes a first set of holes and the second portion including a second set of holes. The first set of holes includes holes of approximately a first size and the second set of holes comprising holes of approximately a second size. The first size is substantially different from the second size.

In another embodiment, an article of footwear includes an upper, the upper including an opening and a fastening region associated with the opening. The article of footwear also includes a tongue, the tongue including a central portion and an outer portion extending between the central portion and an edge of the tongue. The central portion includes a first set of holes having a first size and the outer portion includes a second set of holes having a second size. The first size is substantially different from the second size.

In another embodiment, an article of footwear includes an upper, the upper including an opening and a fastening region associated with the opening. The article of footwear also includes a tongue, the tongue including a central portion, a lateral portion and an upper perimeter portion. The tongue further includes a top portion disposed between the central portion and the upper perimeter portion. The central portion includes a first set of holes having a first size. The lateral portion includes a second set of holes having a second size. The upper perimeter portion includes a third set of holes having a third size. The first size is substantially different from the second size.

Other systems, methods, features and advantages will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
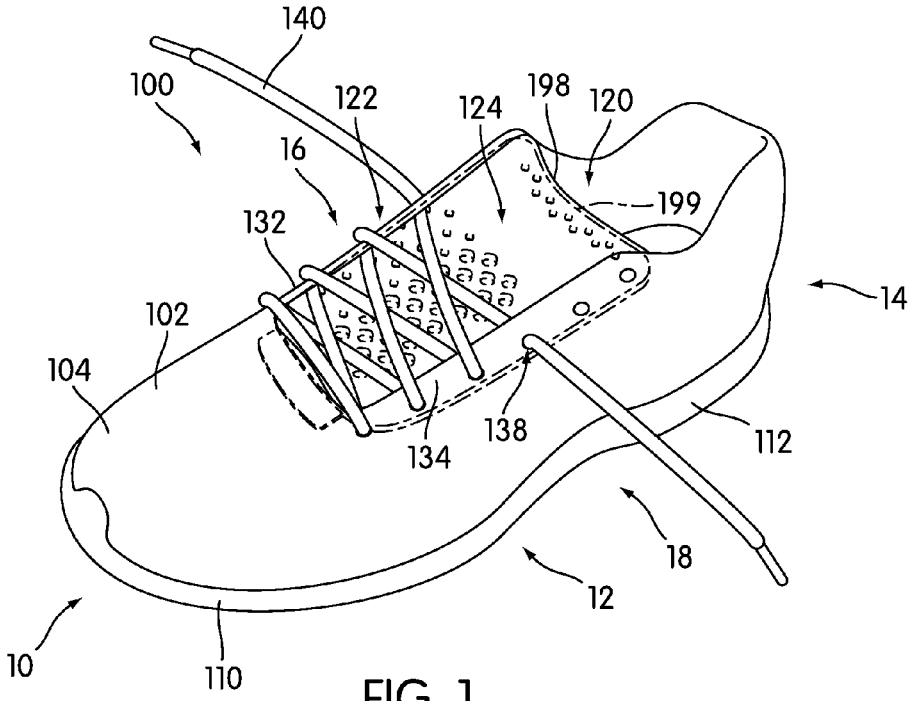
FIG. 1 is an isometric view of an embodiment of an article of footwear including a tongue.
Figure 2:
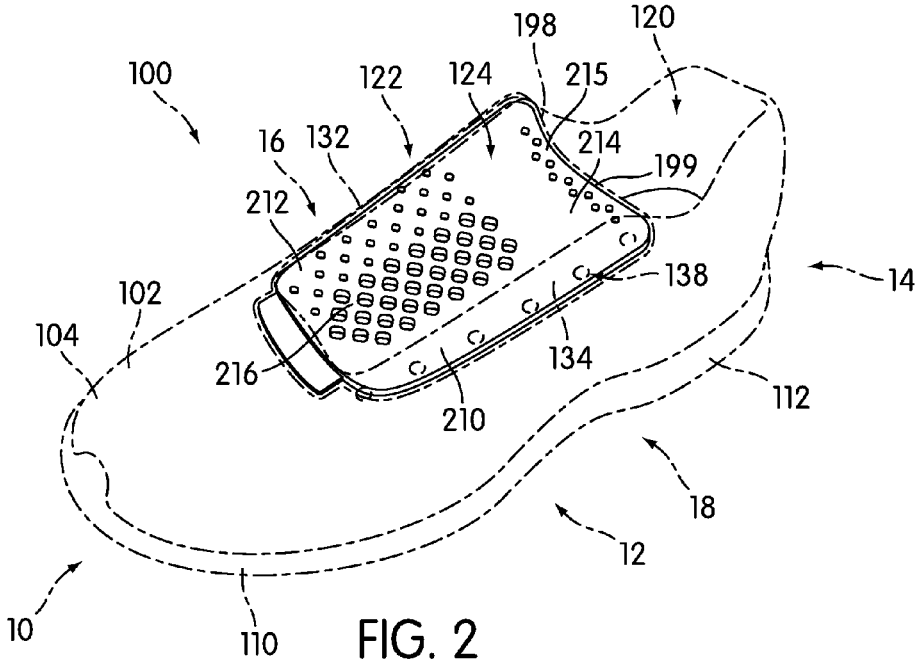
FIG. 2 is an isometric view of an embodiment of an article of footwear including a tongue, in which the upper and sole are shown in phantom.
Figure 3:
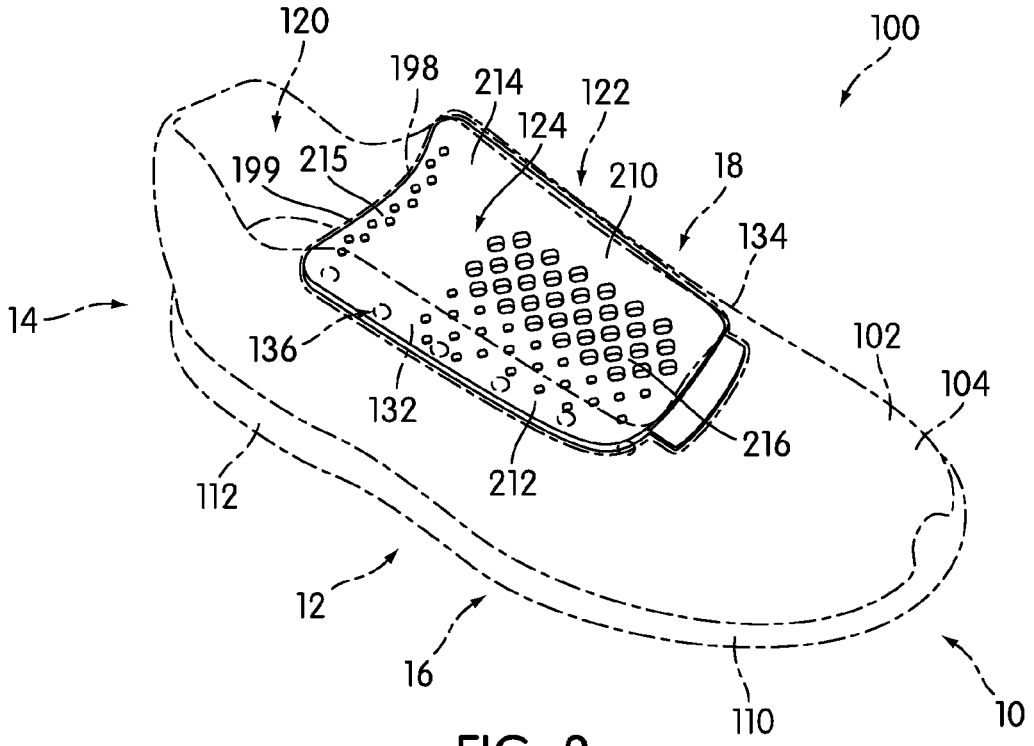
FIG. 3 is an isometric view of an embodiment of an article of footwear including a tongue, in which the upper and sole are shown in phantom.

FIGS. 1 through 3 illustrate views of an embodiment of article of footwear 100. For clarity, the following detailed description discusses an exemplary embodiment, in the form of a sports shoe, but it should be noted that the present embodiments could take the form of any article of footwear including, but not limited to: hiking boots, soccer shoes, football shoes, sneakers, rugby shoes, basketball shoes, baseball shoes as well as other kinds of shoes. Articles of footwear may also take the form of any non-athletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures. As shown in FIGS. 1 through 3, article of footwear 100, also referred to simply as article 100, is intended to be used with a right foot; however, it should be understood that the following discussion may equally apply to a mirror image of article of footwear 100 that is intended for use with a left foot.

Referring to FIGS. 1 through 3, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves. In addition, forefoot portion 10, midfoot portion 12 and heel portion 14, as well as lateral side 16 and medial side 18, can also be applied to individual components of an article, such as a sole structure and/or an upper.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, such as an upper and/or a sole structure.

Article 100 can include upper 102 and sole structure 110. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. In an exemplary embodiment, sole structure 110 may include midsole 112.

In some cases, midsole 112 may be attached directly to upper 102. In other cases, midsole 112 may be attached to a sockliner associated with upper 102. In different embodiments, midsole 112 may have different material characteristics to provide various levels of comfort, cushioning and/or shock absorption. Examples of different materials that could be used for midsole 112 include, but are not limited to: foam, rubber, plastic, polymers, as well as any other kinds of materials.

In some cases, sole structure 110 can also include an outsole. The outsole may be configured to provide traction for sole structure 110 and article 100. An outsole can include one or more tread elements and/or ground penetrating members such as cleats. The outsole can have different material characteristics to provide varying levels of traction with a ground surface. Examples of different materials that could be used for an outsole include, but are not limited to: plastic, rubber, polymers as well as any other kinds of materials that are both durable and wear resistant.

In some embodiments, upper 102 further includes an opening 120 at the heel portion 14 for inserting a wearer's foot into article 100, and a fastening region 122. Opening 120 may be limited to the heel portion 14 of article 100 or may extend along the top of upper 102 into, and include, fastening region 122. Thus, in one embodiment upper 102 may be integrated with fastening region 122. In another embodiment fastening region 122 may be separately affixed to upper 102. Fastening region 122 may be situated along the midfoot portion 12 of upper 102 as shown in FIGS. 1-2, or may be situated at other parts of article 100, as would be apparent to those of skill in the art.

In some embodiments, fastening region 122 may further include lateral fastening portion 132 and medial fastening portion 134. Lateral fastening portion 132 may be disposed along a lateral edge of fastening region 122. Medial fastening portion 134 may be disposed along a medial edge of fastening region 122. Moreover, lateral fastening portion 132 may include first set of eyelets 136 for receiving portions of a lace or other fastener. Likewise, medial fastening portion 134 may include second set of eyelets 138 for receiving portions of a lace or other fastener.

Fastening region 122 may include a fastening system for tightening article 100 around a wearer's foot. Examples of different fastening systems that could be used with fastening region 122 include, but are not limited to: lacing systems, strap systems as well as any other kinds of systems. Thus, fastening region 122 may be configured in a variety of ways to accommodate different types of fastening systems. In some embodiments, fastening region 122 may be provided with laces 140. Laces 140 could be any type of laces configured for use with an article of footwear.

In one embodiment, laces 140 may be configured to engage with fastening region 122. In some cases, laces 140 may be inserted through first set of eyelets 136 and second set of eyelets 138 in an alternating manner. This arrangement allows fastening region 122, and upper 102, to be tightened by pulling on laces 140.

Upper 102 may further include a separate provision, such as tongue 124, which may be attached to upper 102 under fastening region 122. In some cases, tongue 124 may be rigidly attached only at the toe end 104 of upper 102. In other cases, tongue 124 may be additionally rigidly attached along a portion of the fastening region 122. In still other cases, tongue 124 may be attached at the toe end 104 and along the entirety of fastening region 122. Depending on how tongue 124 is attached to upper 102, opening 120 may be of varying sizes when tongue 124 is lifted up from fastening region 122. In addition, tongue 124 may be configured as a portion of upper 102.

Tongue 124 may comprise outer layer 198 and inner layer 199. Outer layer 198 may act as a cover for inner layer 199. Inner layer 199 may function as a cushioning layer in some cases, in order to provide cushioning along the top of a foot. In some embodiments, outer layer 198 cover could comprise a substantially similar material to the material used in constructing the upper. Moreover, outer layer 198 and inner layer 199 could be joined using any methods including, but not limited to: stitching, adhesives as well as any other methods of joining a cover to a component.

For purposes of clarity, outer layer 198 is only shown in FIGS. 1 through 3. In particular, only inner layer 199 of tongue 124 is shown in the remaining Figures to illustrate the structure of inner layer 199. In other embodiments, tongue 124 may not comprise an outer layer and may comprise a single layer of material instead.

Figure 7:
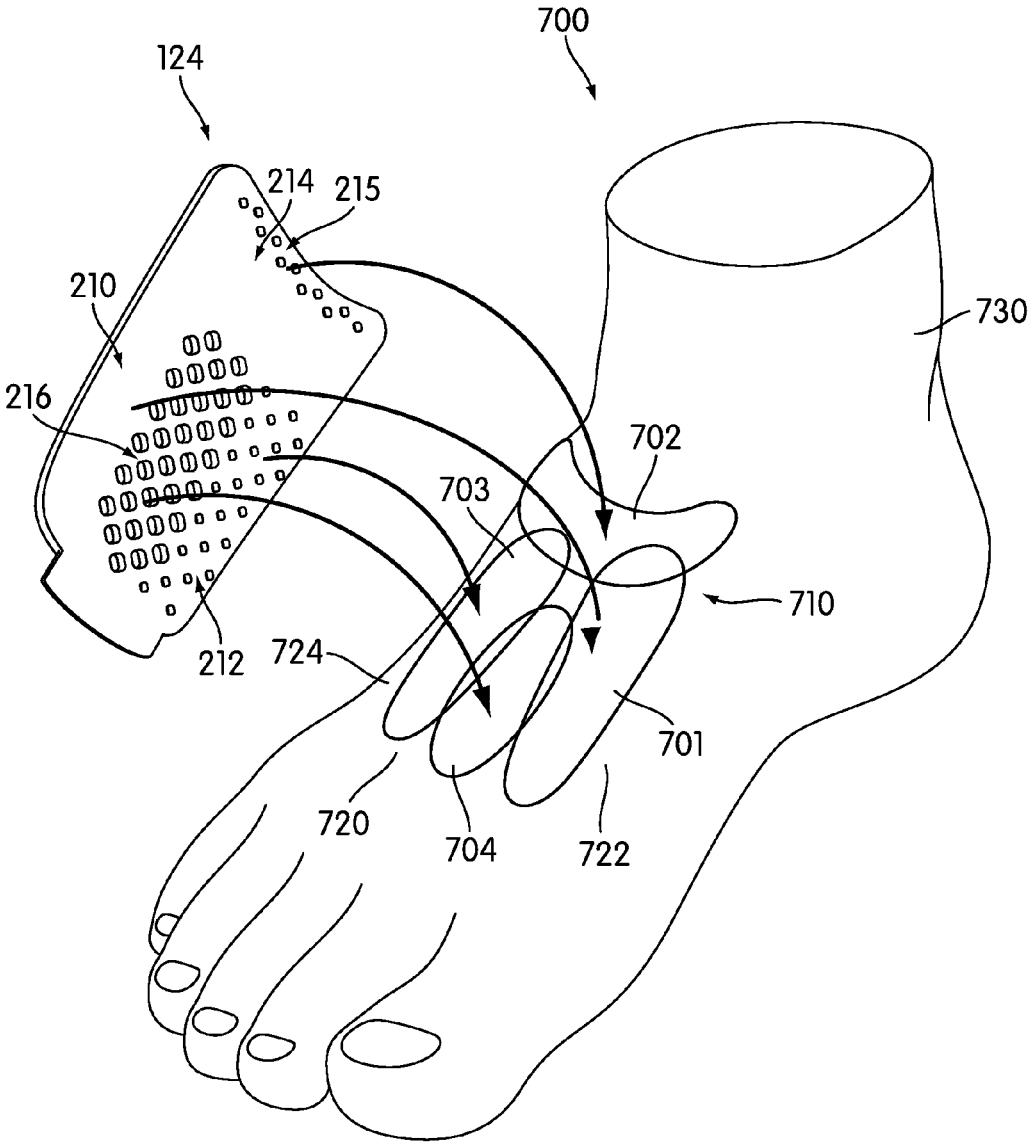
FIG. 7 is an isometric view of an embodiment of a tongue in which various regions of the tongue are in correspondence with various pressure zones on a foot.

As a fastening region is tightened by a fastening system, different portions of the fastening system may apply pressure to regions of a foot. For example, in embodiments where laces are used, as the laces are tightened, the tension applied to the lateral and medial edges of the fastening region may cause increased pressure along portions of a foot. In some cases, the pressure may vary along different portions of a foot, including portions directly adjacent to the fastening region. A particular example of pressure distribution over various portions of a foot are shown in FIG. 7 and discussed in detail below.

An article of footwear can include provisions for reducing pressure that occurs along a fastening region when the upper is tightened. In some embodiments, a tongue may be used to cushion portions of a foot that may experience pressure that occurs along the fastening region. In embodiments where different amounts of pressure occur over different parts of a foot, a tongue can provide differential cushioning in order to provide the most cushioning in regions where the greatest pressure occurs, and to provide the least cushioning in regions where the least pressure occurs. This allows the tongue to facilitate comfort and also maintain flexibility along portions that are not associated with high pressure regions.

Figure 4:
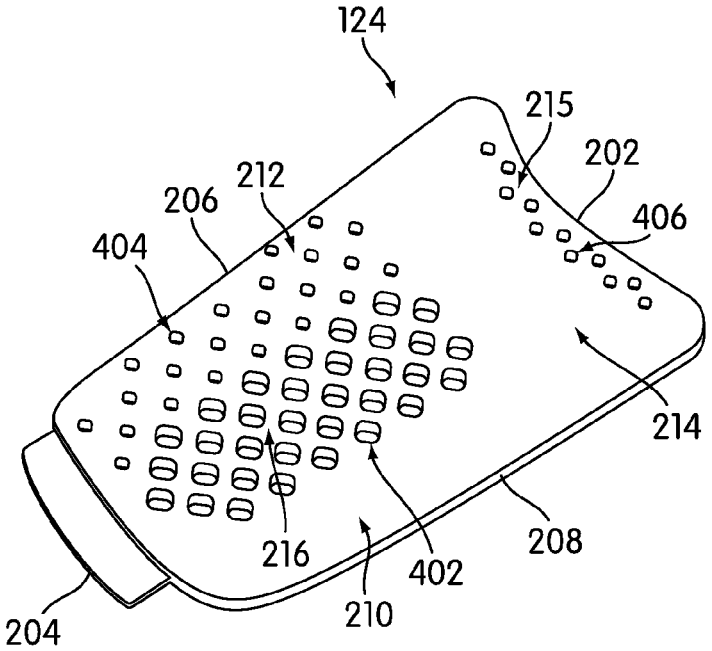
FIG. 4 is an isometric view of an embodiment of a tongue for an article of footwear.

FIG. 4 illustrates isolated isometric views of an embodiment of tongue 124. Tongue 124 is bounded by proximal edge 202, distal edge 204, lateral edge 206 and medial edge 208. Moreover, tongue 124 comprises distinct portions with varying physical characteristics. In particular, tongue 124 includes medial portion 210, lateral portion 212, top portion 214 and upper perimeter portion 215. These portions further bound central portion 216, which is disposed between medial portion 210 and lateral portion 212. Central portion 216 is also distal to top portion 214. In particular, each of medial portion 210, lateral portion 212 and top portion 214 comprise outer portions disposed outwardly of central portion 216.

In order to achieve different cushioning properties along different portions of tongue 124, the volume or density of various portions can be varied. In some embodiments, material can be removed from various portions to lower the volume or density of the corresponding portions. Portions of a tongue with different material volumes or densities may then have substantially different cushioning properties. In particular, portions with high material volumes or densities may have high rigidities. These high rigidity portions may not deform under pressure applied by a fastening system, which helps cushion the underlying region of the foot from the pressure of the fastening system. In contrast, portions of a tongue with low material volumes or densities may have low rigidities. These regions of lower rigidity may deform more easily and therefore provide increased flexibility.

In some embodiments, the material volume or density of a portion may be reduced by incorporating one or more holes into the portion. Referring to FIG. 4, tongue 124 includes multiple sets of holes along different portions. In some embodiments, central portion 216 may include first set of holes 402. Additionally, lateral portion 212 may include second set of holes 404. Furthermore, upper perimeter portion 215 may include third set of holes 406. In some embodiments, top portion 214 and medial portion 210 may not include any holes. Instead, top portion 214 and medial portion 210 may be substantially solid portions with maximum material volumes. In other embodiments, however, top portion 214 and/or medial portion 210 could include one or more holes.

Figure 5:
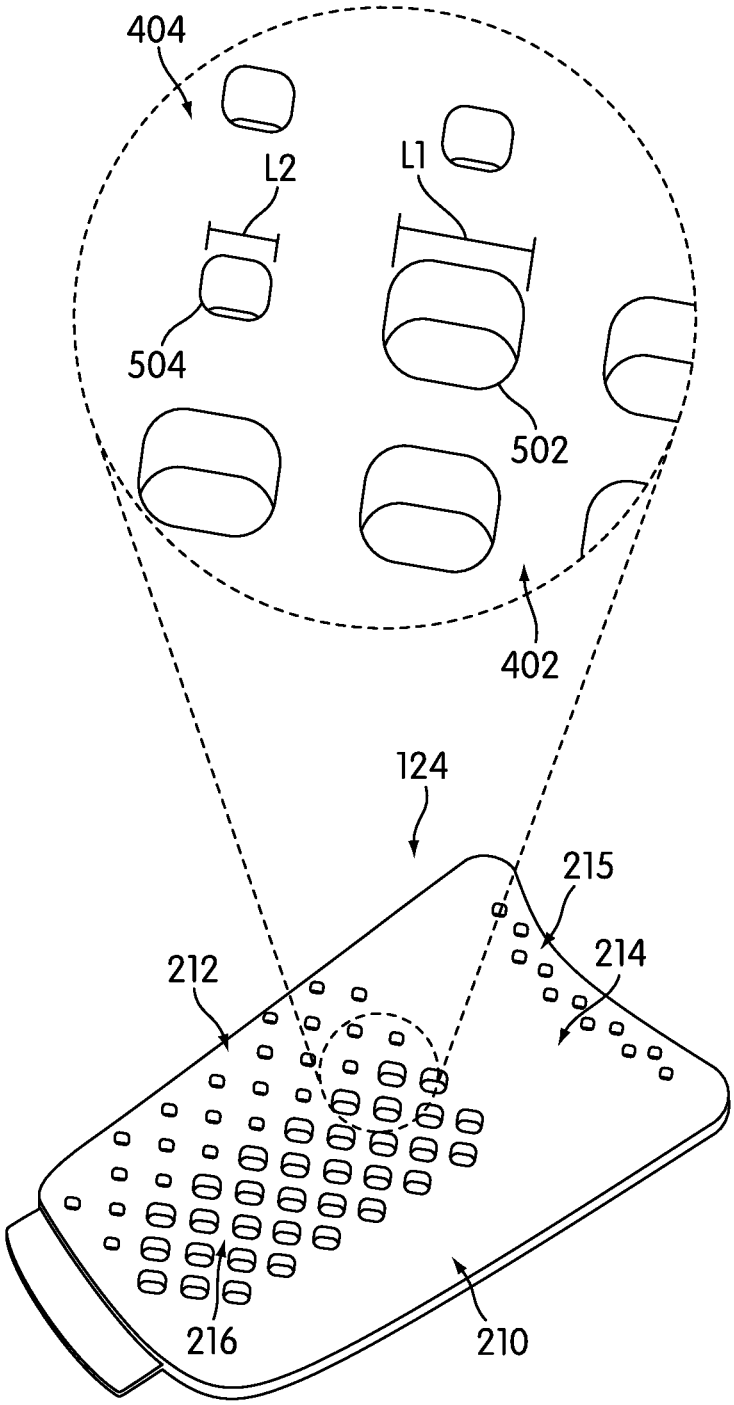
FIG. 5 is an isometric view of an embodiment of a tongue for an article of footwear including an enlargement of a central portion and a lateral portion.
Figure 6:
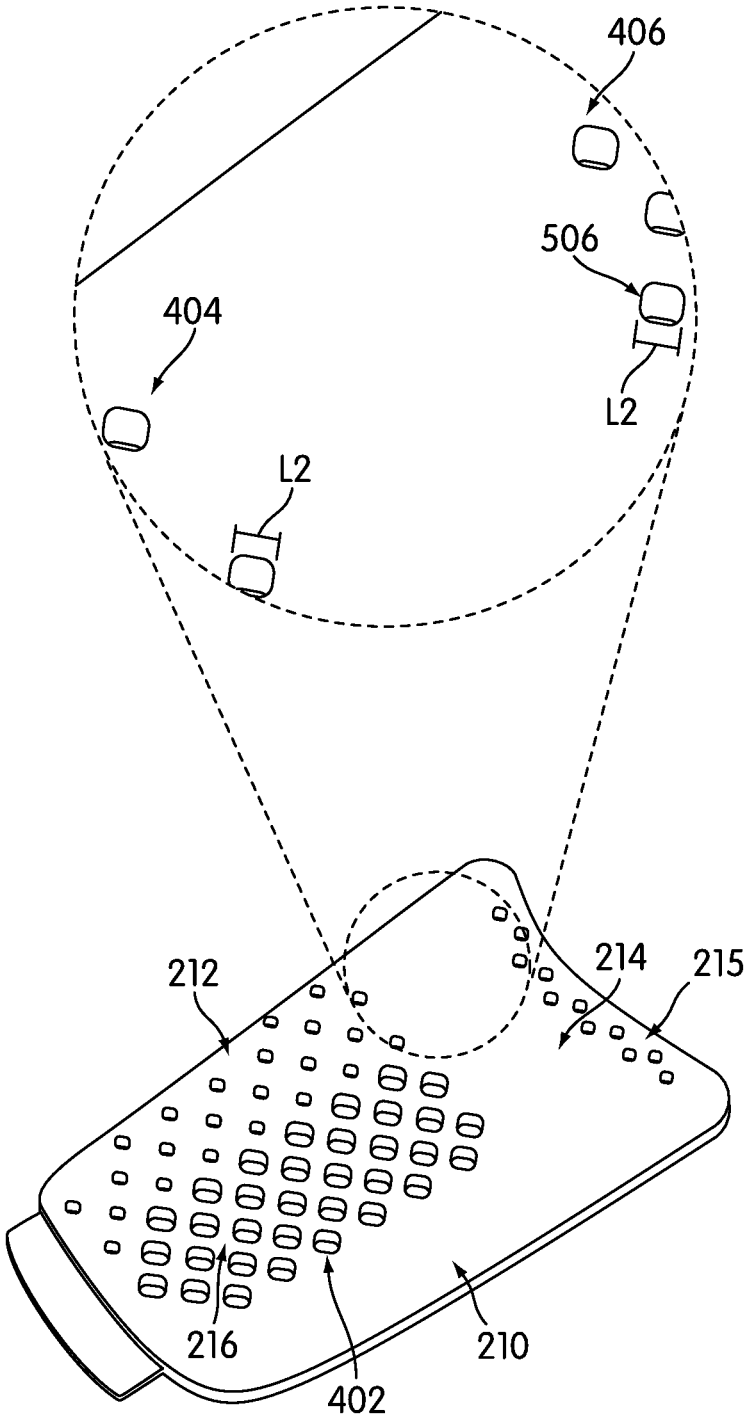
FIG. 6 is an isometric view of an embodiment of a tongue including an enlargement of a lateral portion and an upper peripheral portion.

FIGS. 5 and 6 illustrate isometric views of tongue 124 including enlarged views of various regions. In particular, FIG. 5 illustrates an isometric view of tongue 124 with an enlarged view of central portion 216 and lateral portion 212, while FIG. 6 illustrates an isometric view of tongue 124 with an enlarged view of lateral portion 212, top portion 214 and upper perimeter portion 215.

Referring to FIGS. 5 and 6, the shapes of one or more holes of tongue 124 can vary. In some embodiments, a set of holes can include holes of substantially similar shapes. In other embodiments, a set of holes can include holes of varying shapes. Moreover, in some embodiments, the shapes of holes could vary across different portions of tongue 124. In other embodiments, the shapes of holes may be approximately similar across different portions of tongue 124.

In one embodiment, the shapes of holes in first set of holes 402, second set of holes 404 and third set of holes 406 may be substantially similar. In particular, each hole may have a shape that is square-like. Moreover, the corners of each hole may be rounded. In other embodiments, however, the holes in tongue 124 could have any other shapes including, but not limited to: rounded, circular, rectangular, triangular, pentagon-like, hexagon-like, polygonal, regular, irregular as well as any other kinds of shapes. In still other embodiments, the shape of a hole may vary from one portion to another. Also, in some cases, the shapes of holes within the same portion could be varied.

In order to achieve different material volumes for different portions of tongue 124, the sizes of holes could be varied. In some embodiments, the sizes of holes within a particular portion of tongue 124 may be approximately constant. In other embodiments, the sizes of holes within a particular portion of tongue 124 could vary. In addition, in some embodiments, the sizes of holes may vary between different portions of tongue 124. In still other embodiments, the sizes of holes in different portions of tongue 124 may be substantially similar.

In one embodiment, the sizes of holes within first set of holes 402 may be approximately similar. For example, hole 502 of first set of holes 402 has a size characterized by length L1, which is the length of a side of hole 502. In some cases, each of the remaining holes of first set of holes 402 may be substantially similar in size to hole 502. Likewise, hole 504 of second set of holes 404 has a size characterized by length L2, which is the length of a side of hole 504. In some cases, each of the remaining holes of second set of holes 404 may be substantially similar in size to hole 504. Additionally, hole 506 of third set of holes 406 also has a size characterized by length L2, which is the length of a side of hole 506. In some cases, each of the remaining holes of third set of holes 406 may be substantially similar in size to hole 506.

In some embodiments, the relative sizes of length L1 and length L2 can vary. In some cases, length L1 could be greater than length L2. In other cases, length L2 could be greater than length L1. In one embodiment, length L1 is substantially greater than length L2. In other words, first set of holes 402 may be substantially larger in size than second set of holes 404. Moreover, since third set of holes 406 also has length L2, first set of holes 402 may be substantially larger in size than third set of holes 406.

In some embodiments, holes can be applied to tongue 124 in a manner that achieves a particular reduction in material volume. For example, in some embodiments, first set of holes 402 may be applied in a manner that achieves a reduction of material volume in the range between 40% and 80% of the potential material volume of central portion 216. In other words, first set of holes 402 reduces the material volume of central portion 216 by between 40% and 80% of what the volume of central portion 216 would be without any holes. In other embodiments, first set of holes 402 could be applied in any manner to achieve any other desired reduction in material volume. In one embodiment, first set of holes 402 may be applied in a manner that achieves an approximately 60% reduction in material volume for central portion 216. In some embodiments, second set of holes 404 may be applied in a manner that achieves a reduction of material volume in the range between 5% and 50% for lateral portion 212. In other embodiments, second set of holes 402 could be applied in any manner to achieve any other desired reduction in material volume for lateral portion 212. In one embodiment, second set of holes 404 may be applied in a manner that achieves approximately a 30% reduction in material volume for lateral portion 212. Likewise, in some embodiments, third set of holes 406 could be applied in a manner that achieves a reduction of material volume in the range between 5% and 50% of upper perimeter portion 215. In other embodiments, third set of holes 406 could be applied in any manner to achieve any other desired reduction in material volume for upper perimeter portion 215. In one embodiment, third set of holes 406 could be applied in a manner that achieves approximately a 30% reduction in material volume for upper perimeter portion 215.

Using this particular arrangement of sizes for holes on tongue 124 provides differential cushioning across tongue 124. In particular, portions with the largest holes have the greatest reductions in material volume, and therefore provide the least amount of support or cushioning. In contrast, portions with no holes have the largest material volume or density, and therefore provide the greatest amount of support of cushioning. In this case, since top portion 214 and medial portion 210 have no holes, these portions are the most rigid and may provide the greatest support against pressure applied by a fastening system. Central portion 216, which has the largest holes, is the most flexible portion, and central portion 216 may be associated with the lowest amount of pressure applied by a fastening system. Lateral portion 212 and upper perimeter portion 215 have holes that are smaller than the holes in central portion 216, and therefore lateral portion 212 and upper perimeter portion 215 may provide more support against fastening pressure than central portion 216, but less support than top portion 214 and medial portion 210.

In different embodiments, the number of holes associated with each portion of tongue 124 could vary. In some cases, each set of holes may comprise one or more holes. Moreover, the number of holes in a portion may vary according to the size of the portion. For example, central portion 216, which has the greatest area, may have more holes than lateral portion 212, which has less area than central portion 216. In some cases, the number of holes in a given portion may be selected to achieve a desired material volume or density of the portion. It will be understood that the embodiments are not limited to a certain number of holes in each portion and in other embodiments the number of holes in different portions could vary.

Generally, the configuration or arrangement of holes in different portions of tongue 124 could vary. In some embodiments, holes could be regularly arranged throughout each portion. For example, in the current embodiment, first set of holes 402, second set of holes 404 and third set of holes 406 may be approximately evenly distributed throughout central portion 216, lateral portion 212 and upper perimeter portion 215, respectively. However, in other embodiments, holes could be irregularly distributed throughout any of the portions of tongue 124. In some cases, holes could be distributed or arranged in various different patterns. In some cases, holes could be arranged in a particular design, to improve the aesthetic quality of tongue 124.

In different embodiments, the depths of each hole could vary. In some cases, including the embodiments illustrated in the Figures, each hole may extend through the entire thickness of tongue 124. However, in other embodiments, holes may only extend through a portion of tongue 124. In some cases, some holes could extend through the entire thickness of tongue 124, while others may only extend partially through the thickness of tongue 124.

In still other embodiments, it may be possible to reduce the material volume or density of various portions in various different ways. For example, in some cases, some portions of a tongue could be hollowed out to achieve reduced material volume. In other cases, different portions could be made of different materials that are characterized by different rigidities, weights, elasticity as well as other material properties.

Figure 8:
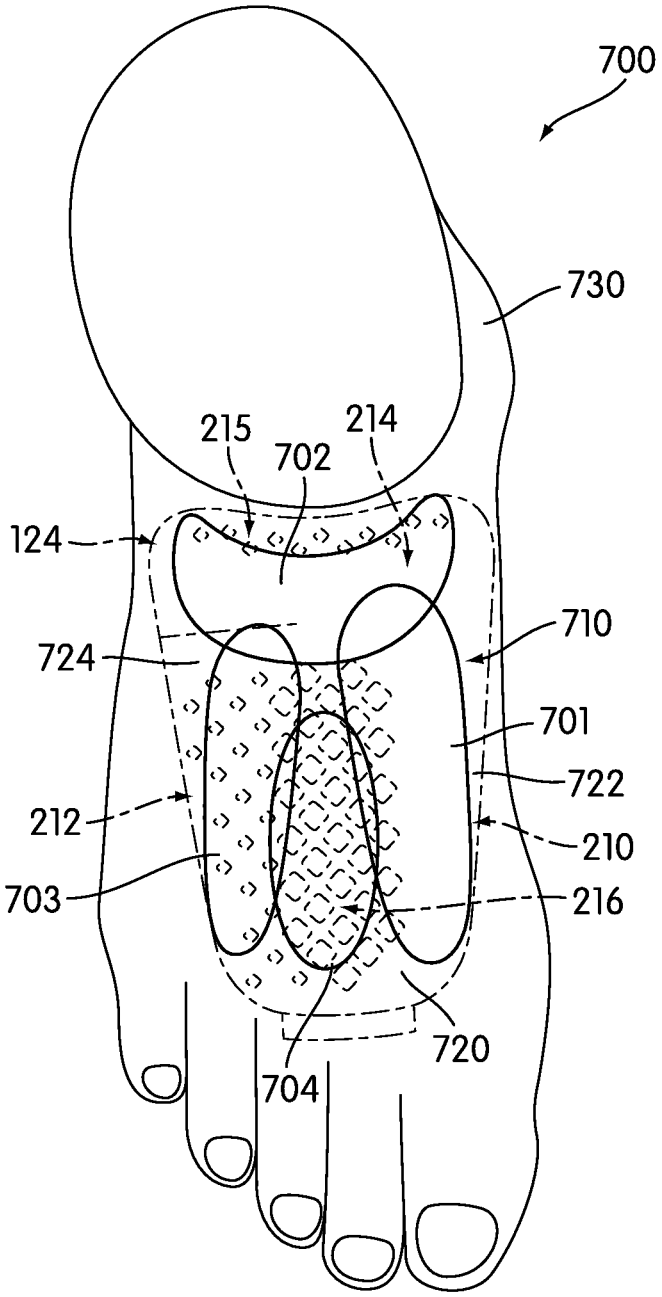
FIG. 8 is a top down view of an embodiment of a tongue in which various regions of the tongue are in correspondence with various pressure zones on a foot.

FIGS. 7 and 8 illustrate views of tongue 124 in relationship to foot 700. Foot 700 may comprise various different pressure zones or regions where pressure can build up on the foot when a fastening system is tightened. In this case, foot 700 includes first pressure zone 701, second pressure zone 702, third pressure zone 703 and fourth pressure zone 704, which may be collectively referred to as pressure zones 710. Pressure zones 710 are generally associated with top portion 720 of foot 700, as well as the medial and lateral sides adjacent to the top of the foot. In particular, first zone 701 is disposed on medial side 722 of top portion 720 and third zone 703 is associated with lateral side 724 of top portion 720. In addition, second pressure zone 702 is disposed on top portion 720 adjacent to ankle 730. Fourth pressure zone 704 is disposed centrally within top portion 720, between medial side 722 and lateral side 724.

Each zone may be associated with different amounts of pressure when a fastening system is tightened. In some cases, first pressure zone 701 and second pressure zone 702 are the highest pressure zones, due to the pressure applied along medial fastening portion 134 of fastening region 122 (see FIG. 1) and the top of fastening region 122, respectively. As a fastening system is tightened, medial fastening portion 134 of fastening region 122 may be pulled against foot 700 at first pressure zone 701. Also, a fastener (such as lace 140) may extend across fastening region 122 and apply pressure at second pressure zone 802.

In some cases, fourth pressure zone 704 may be associated with the lowest pressures. This may occur since a fastener, such as lace 140, may extend over, but not apply pressure across, fourth pressure zone 704. Finally, third pressure zone 703 may be associated with intermediate pressures that are between the highest pressures (along first pressure zone 701 and second pressure zone 702) and the lowest pressures (along fourth pressure zone 704). The pressure in third pressure zone 703 may occur as lateral fastening portion 132 of fastening region 122 is pulled against foot 700 as lace 140 is tightened.

In order to alleviate the pressure applied in pressure zones 710, tongue 124 may provide cushioning between top portion 720 of foot 700 and a fastening system. In some embodiments, tongue 124 is configured to provide differential cushioning using portions of varying material volume or density. In the current embodiment, medial portion 210 is configured to be aligned with first pressure zone 701 when foot 700 is inserted into article 100 (see FIG. 1). Moreover, medial portion 210 may be disposed beneath medial fastening portion 134 of fastening region 122 (see FIG. 2). Top portion 214 is configured to be aligned with second pressure zone 702. With this arrangement, the portions of tongue 124 with the greatest material volume or density may be disposed on the highest pressure zones. In addition, lateral portion 212 is configured to be aligned with third pressure zone 703. In particular, lateral portion 212 may be disposed beneath lateral fastening portion 132 of fastening region 122 (see FIG. 3). Central portion 216 is configured to be aligned with fourth pressure zone 704. With this arrangement, the portions of intermediate material volume or density and lowest material volume or density may be disposed on the zones of intermediate pressure and lowest pressure, respectively. Moreover, upper perimeter portion 215 may be associated with an area above second pressure zone 702, which is an area that experiences little or no pressure from a fastening system. The overall configuration of tongue 124 may help to evenly distribute instep lacing pressure.

The previous embodiments discuss exemplary configurations for a tongue. In other embodiments, the material volumes of one or more portions of a tongue could be varied in any other manner. For example, in some cases, holes could be applied to both a lateral portion and a medial portion. In other cases, holes could be applied to a top portion.

Figure 9:
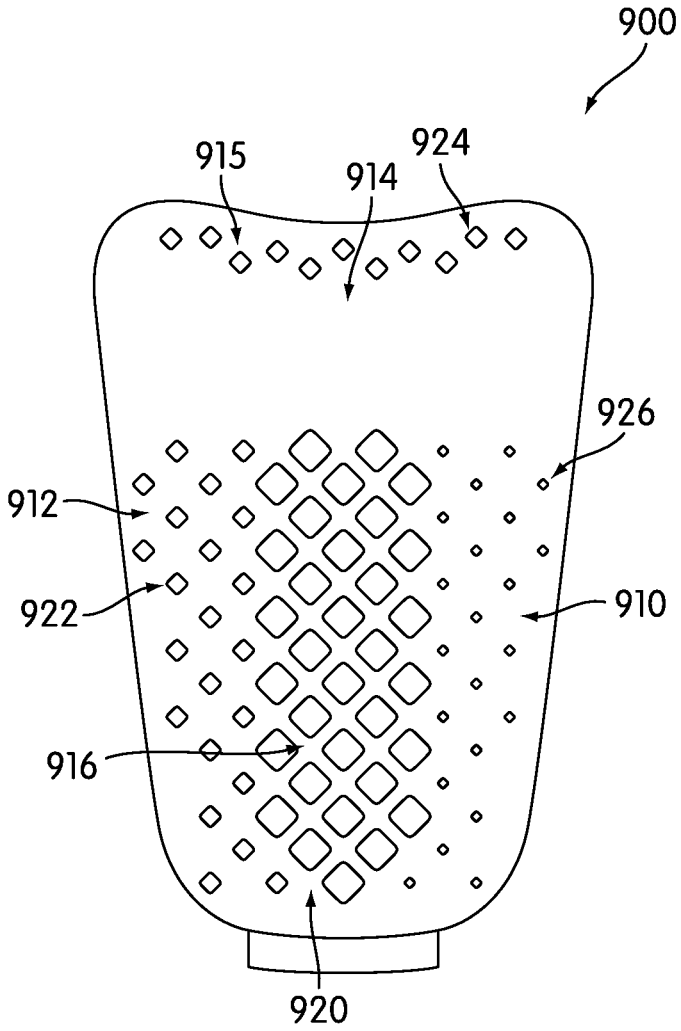
FIG. 9 is a schematic view of an embodiment of a tongue in which some material has been removed from all portions of the tongue except for the top portion.
Figure 10:
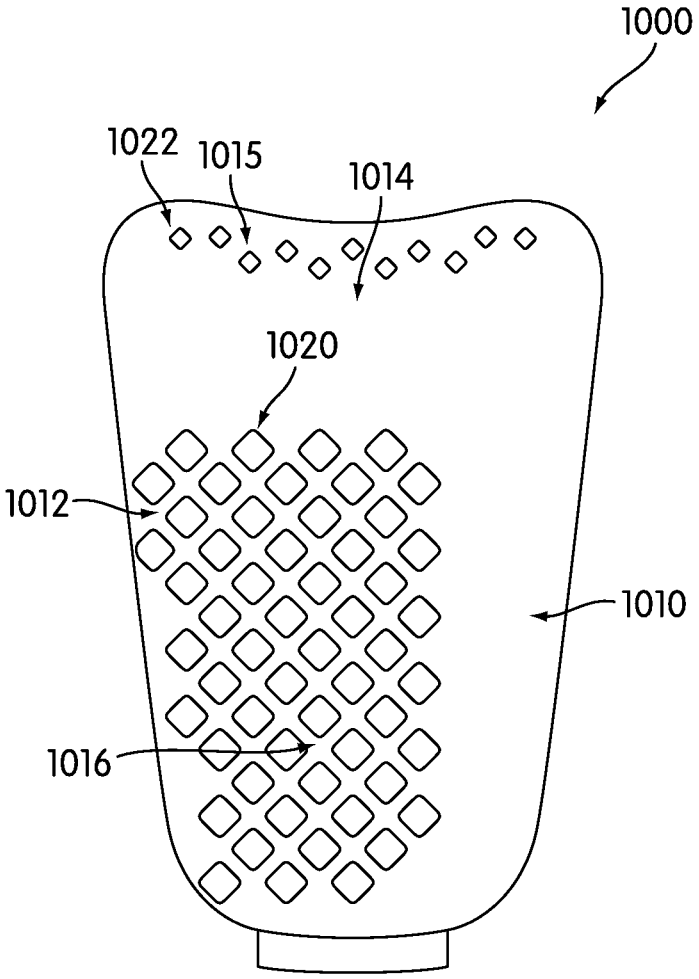
FIG. 10 is a schematic view of an embodiment of a tongue in which the same amount of material has been removed from a central portion and a lateral portion.
Figure 11:
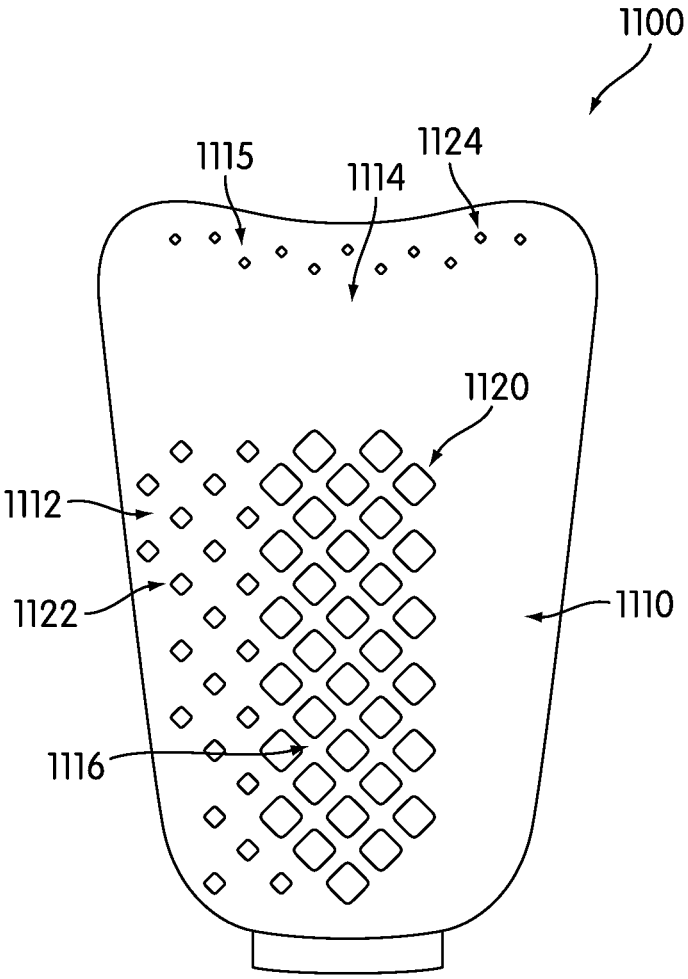
FIG. 11 is a schematic view of an embodiment of a tongue including three portions in which material has been removed.

FIGS. 9 through 11 illustrate embodiments for alternative configurations of a tongue (note that reference numbers carry over for like parts throughout the detailed description and the figures). Referring to FIG. 9, tongue 900 comprises medial portion 910, lateral portion 912, top portion 914, central portion 916 and upper perimeter portion 915. In some respects, tongue 900 may be substantially similar to tongue 124 shown above. In particular, tongue 900 includes first set of holes 920 in central portion 916, second set of holes 922 in lateral portion 912 and third set of holes 924 in upper perimeter portion 915. In addition, tongue 900 includes fourth set of holes 926 in medial portion 910. By applying holes to medial portion 910, the rigidity of medial portion 910 may be modified.

In some embodiments, the size of fourth set of holes 926 may be less than the sizes of first set of holes 920, second set of holes 922 and third set of holes 924. This allows the rigidity of medial portion 910 to remain greater than the rigidity of lateral portion 912, central portion 916 and upper perimeter portion 915. However, since top portion 914 does not include any holes, top portion 914 may retain a greater rigidity than medial portion 910. This type of configuration may be useful in situations where pressure from a fastening system is greatest in zone 802 (see FIGS. 7 and 8).

In some embodiments, the sizes of holes in a central portion and a lateral portion could be substantially similar. Referring to FIG. 10, tongue 1000 comprises medial portion 1010, lateral portion 1012, top portion 1014, central portion 1016 and upper perimeter portion 1015. In this embodiment, tongue 1000 includes first set of holes 1020 and second set of holes 1022. First set of holes 1020 is associated with both central portion 1016 and lateral portion 1012. Second set of holes 1022 is associated with upper perimeter portion 1015. Using this configuration, the material volume of central portion 1016 and lateral portion 1012 may be substantially similar. Moreover, the relatively large size of holes in first set of holes 1020 allows central portion 1016 and lateral portion 1012 to be more flexible than top portion 1014, medial portion 1010 and upper perimeter portion 1015. This configuration may be useful in situations where pressure from a fastening system is mostly absent along the lateral edge of a fastening region as well as in the center of the fastening region.

In some embodiments, the sizes of holes along an upper perimeter portion and a lateral portion could be substantially different. Referring to FIG. 11, tongue 1100 comprises medial portion 1110, lateral portion 1112, top portion 1114, central portion 1116 and upper perimeter portion 1115. In this embodiment, first set of holes 1120, second set of holes 1122 and third set of holes 1124 are associated with central portion 1116, lateral portion 1112 and upper perimeter portion 1115, respectively. Moreover, in this case, the sizes of holes in third set of holes 1124 is substantially smaller than the sizes of holes in second set of holes 1122. This arrangement allows upper perimeter portion 1115 to provide increased rigidity over lateral portion 1112, which increase support and cushioning in upper perimeter portion 1115. This configuration may be useful in situations where zone 702 (see FIGS. 7 and 8) extends higher up along a foot.

Generally, a tongue with holes of varying sizes could be manufactured in any manner. In some embodiments, a tongue could be molded with holes of different sizes. In other embodiments, a tongue could be created as a solid piece and then holes could be applied to the tongue using a drill, knife, laser, cutting press or any other method known in the art for applying holes.

Generally, any materials known in the art for use with footwear can be used with the tongues discussed above. Examples of materials include, but are not limited to: plastic, foam, fabric, canvas, leather, wood, rubber, metal as well as any other materials known in the art. In some embodiments, a tongue could be made using a knit material (such as various yarns or threads). In some cases, a tongue with holes could be formed using a knitting process. An example of such a knitting process for forming tongues and other knitted elements is disclosed in Greene et al., U.S. patent application Ser. No. 12/574,876, filed Oct. 7, 2009, now U.S. Patent Application Publication Number 2011/0078921 A1, published on Apr. 7, 2011, the entirety of which is hereby incorporated by reference. In cases where a tongue is formed using a knitting process, any suitable knitting materials could be used.

Although the current embodiment discusses a tongue used with a lacing system, it will be understood that in other embodiments, a tongue with holes of varying sizes could be used with any type of fastening system that can create pressure. Examples of different fastening systems that could be used with a tongue having holes of varying sizes include, but are not limited to: laces, straps, buttons, snaps, zippers as well as any other kinds of fastening systems.

In some embodiments, a cover or outer layer could be applied to a tongue. The cover could comprise any kind of material and may improve the aesthetic design of the tongue by covering holes. In some embodiments, a cover could comprise a substantially similar material to the material used in constructing the upper. Moreover, a cover could be applied to a tongue using any methods including, but not limited to: stitching, adhesives as well as any other methods of joining a cover to a component.

While various embodiments have been described, the description is intended to be exemplary, rather than limiting and it will be apparent to those of ordinary skill in the art that many more embodiments and implementations are possible. Accordingly, the invention is not to be restricted except in light of the attached claims and their equivalents. Also, various modifications and changes may be made within the scope of the attached claims.

We claim:

1. An article of footwear, comprising:

an upper, the upper including an opening and a fastening region associated with the opening; and a tongue, the tongue including a first portion and a second portion disposed laterally with respect to the first portion, the first portion being disposed on an interior side of the fastening region of the upper;

the first portion including a first set of holes arranged in a first configuration providing a first material volume, wherein each hole of the first set of holes has a first hole size and a first hole shape, and wherein the first configuration has a first hole pattern, and the second portion including a second set of holes arranged in a second configuration providing a second material volume, wherein each hole of the second set of holes has a second hole size and a second hole shape, and wherein the second configuration has a second hole patten; wherein the first configuration is different than the second configuration;

wherein the first material volume associated with the first configuration in the first portion is substantially different than the second material volume associated with the second configuration in the second portion, thereby varying a material volume of the tongue asymmetrically in a medial to lateral direction of the tongue.

2. The article of footwear according to claim 1, wherein the first portion is a lateral portion of the tongue.

3. The article of footwear according to claim 2, wherein the second portion is a central portion of the tongue.

4. The article of footwear according to claim 3, wherein the first set of holes comprises holes each of approximately a first size and the second set of holes comprises holes each of approximately a second size, and the second size is substantially greater than the first size.

5. The article of footwear according to claim 1, wherein the first material volume associated with the first portion is substantially greater than the second material volume associated with the second portion.

6. The article of footwear according to claim 3, wherein the first set of holes comprises holes each of approximately a first depth and the second set of holes comprises holes each of approximately a second depth, and the second depth is substantially greater than the first depth.

7. An article of footwear, comprising:

an upper, the upper including an opening and a fastening region associated with the opening; and a tongue, the tongue including a central portion and an outer portion extending between the central portion and an edge of the tongue, at least the outer portion being disposed on an interior side of the fastening region of the upper;

the central portion including a first set of holes having a first configuration providing a first material volume, each hole of the configuration having a first hole size and a first hole shape, and wherein the first configuration has a first hole pattern; and the outer portion including a second set of holes having a second configuration providing a second material volume, each hole of the configuration having a second hole size, a second hole shape, and wherein the second configuration has a second hole pattern;

wherein the first material volume associated with the first set of holes formed in the central portion is substantially different than the second material volume associated with the second set of holes formed in the outer portion, thereby varying a material volume of the tongue asymmetrically in a medial to lateral direction of the tongue.

8. The article of footwear according to claim 7, wherein the outer portion is a lateral portion.

9. The article of footwear according to claim 7, wherein the outer portion is a medial portion.

10. The article of footwear according to claim 7, wherein the outer portion includes a top portion disposed between the central portion and a proximal edge of the tongue, and wherein at least part of the top portion is disposed on an interior side of a lacing system of the fastening region.

11. The article of footwear according to claim 7, wherein the outer portion includes an upper perimeter portion disposed along a proximal edge of the tongue.

12. The article of footwear according to claim 7, wherein the tongue further includes a third portion, wherein the third portion includes a third set of holes having a third configuration providing a third material volume, each hole of the third configuration having a third constant hole size and a third constant hole shape, and wherein the third configuration has a third hole pattern, and wherein the third material volume associated with the third set of holes formed in the third portion is substantially different than the first material volume associated with the first set of holes formed in the first portion and the second material volume associated with the second set of holes formed in the second portion.

13. The article of footwear according to claim 7, wherein the tongue comprises an outer layer and an inner layer and wherein the central portion and the outer portion are associated with the inner layer.

14. An article of footwear, comprising:

an upper, the upper including an opening and a fastening region associated with the opening; and a tongue, the tongue including a central portion, a lateral portion, and an upper perimeter portion, at least the lateral portion being disposed on an interior side of the fastening region;

the tongue further including a top portion disposed between the central portion and the upper perimeter portion;

the central portion including a first set of holes having a first configuration providing a first material volume, each hole of the first configuration having a first hole size and a first hole shape, and wherein the first configuration has a first hole pattern;

the lateral portion including a second set of holes having a second configuration providing a second material volume, each hole of the second configuration having a second, hole size and a second hole shape, and wherein the second configuration has a second hole pattern;

the upper perimeter portion including a third set of holes having a third configuration providing a third material volume, each hole of the third configuration having a third constant hole size and a third constant hole shape, and wherein the third configuration has a third hole pattern; and the top portion extending a distance from the upper most hole of the central portion to the upper perimeter portion, the upper most hole of the central portion having a size characterized by a length, the distance from the upper most hole of the central portion to the upper perimeter portion being greater than two lengths of the upper most hole of the central portion;

wherein a fourth material volume associated with the top portion is greater than the first material volume associated with the central portion, the fourth material volume of the top portion being equal to a material volume of the tongue material in the absence of any holes; and wherein the first material volume associated with the central portion is substantially different than the second material volume associated with the lateral portion.

15. The article of footwear according to claim 14, wherein the first material volume associated with the central portion is substantially less than the second material volume associated with the lateral portion.

16. The article of footwear according to claim 14, wherein the second material volume associated with the lateral portion is substantially equal to the third material volume associated with the upper perimeter portion.

17. The article of footwear according to claim 14, wherein the first set of holes reduces the material volume of the central portion by an amount in the range between 50% and 80% relative to a material volume of the tongue material in the absence of the first set of holes.

18. The article of footwear according to claim 14, wherein the second set of holes reduces the material volume of the lateral portion by an amount in the range between 10% and 40% relative to a material volume of the tongue material in the absence of the second set of holes.

19. The article of footwear according to claim 14, wherein the third set of holes reduces the material volume of the upper perimeter portion by an amount in the range between 10% and 40% relative to a material volume of the tongue material in the absence of the third set of holes.

20. The article of footwear according to claim 14, wherein the tongue is formed of a permeable material.

* * * * *